US011119430B2

(12) United States Patent
Suzuki et al.

(10) Patent No.: US 11,119,430 B2
(45) Date of Patent: Sep. 14, 2021

(54) TECHNOLOGY FOR ASCERTAINING STATE OF MEMBERS CONSTITUTING IMAGE FORMING APPARATUS

(71) Applicant: CANON KABUSHIKI KAISHA, Tokyo (JP)

(72) Inventors: Masahiro Suzuki, Numazu (JP); Shun-ichi Ebihara, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/920,945

(22) Filed: Jul. 6, 2020

(65) Prior Publication Data

US 2021/0018868 A1 Jan. 21, 2021

(30) Foreign Application Priority Data

Jul. 19, 2019 (JP) ..... JP2019-134012

(51) Int. Cl.
*G03G 15/00* (2006.01)

(52) U.S. Cl.
CPC ..... *G03G 15/5062* (2013.01); *G03G 15/5058* (2013.01)

(58) Field of Classification Search
CPC ..... G03G 15/5058; G03G 15/5062; G03G 15/5075; G03G 15/5079; G03G 15/5083; G03G 15/55; G03G 15/553; G03G 15/556
See application file for complete search history.

(56) References Cited

U.S. PATENT DOCUMENTS

| | | | | |
|---|---|---|---|---|
| 7,643,765 | B2 | 1/2010 | Miyaji et al. | |
| 7,965,397 | B2 * | 6/2011 | Paul | G03G 15/5062 358/1.1 |
| 10,324,406 | B2 | 6/2019 | Endoh et al. | |
| 2006/0024070 | A1 * | 2/2006 | Shim | G03G 15/553 399/12 |
| 2006/0153582 | A1 * | 7/2006 | Mo | G03G 15/5041 399/49 |
| 2011/0158667 | A1 * | 6/2011 | Ishii | G03G 15/5062 399/49 |
| 2016/0085196 | A1 * | 3/2016 | Shirafuji | G03G 15/5041 399/49 |

FOREIGN PATENT DOCUMENTS

| | | |
|---|---|---|
| JP | 2008-009176 A | 1/2008 |
| JP | 2016-153855 A | 8/2016 |

* cited by examiner

*Primary Examiner* — Hoang X Ngo
(74) *Attorney, Agent, or Firm* — Venable LLP

(57) ABSTRACT

An image forming apparatus includes an image forming unit, a control unit, a reading unit, an analysis unit, a storage unit, and a computation unit. The image forming unit forms an image on a sheet. The control unit controls the image forming unit. The reading unit reads the sheet. The analysis unit analyzes a reading result acquired by the image formed on the sheet being read by the reading unit, and outputs an analysis result. The storage unit stores a printing condition used when the image was formed and the analysis result in association with each other. The computation unit computes a control parameter to be used by the control unit in order to control the image forming unit, with reference to the analysis result and the printing condition stored in the storage unit.

31 Claims, 10 Drawing Sheets

| ANALYSIS RESULT | PRINTING CONDITION | |
|---|---|---|
| OFFSET DENSITY | SHEET COUNT | CORRECTION AMOUNT |
| Doff0 | N0 | C0 |
| : | : | : |
| Doff1 | N1 | C1 |
| Doff2 | N2 | C2 |
| Doff3 | N3 | C3 |
| : | : | : |

TECHNOLOGY FOR ASCERTAINING STATE OF MEMBERS CONSTITUTING IMAGE FORMING APPARATUS

BACKGROUND OF THE INVENTION

Field of the Invention

The present invention relates to a technology for ascertaining the state of members constituting an image forming apparatus.

Description of the Related Art

The characteristics of members (e.g., fixing film) constituting an image forming apparatus change little by little whenever an image is formed. This is because the members wear or deteriorate little by little. Accordingly, control parameters of the members are corrected according to the deterioration of the members. Japanese Patent Laid-Open No. 2016-153855 proposes to determine the remaining lifetime of a member by reading an image output by the image forming apparatus.

Incidentally, when printing conditions used when an image is formed are stored in association with the result of reading the image (analysis result), the way in which the state of the image forming apparatus transitions is known. Accordingly, it should be possible to accurately derive the control parameters of the image forming apparatus by referring to the stored information. The stored information is also likely to be useful in order to ascertain the state (e.g., remaining lifetime, etc.) of the members of the image forming apparatus.

SUMMARY OF THE INVENTION

The present invention provides an image forming apparatus comprising the following elements. An image forming unit is configured to form an image on a sheet. A control unit is configured to control the image forming unit. A reading unit is configured to read the sheet. An analysis unit is configured to analyze a reading result acquired by the image formed on the sheet being read by the reading unit, and output an analysis result. A storage unit is configured to store a printing condition used when the image was formed and the analysis result in association with each other. A computation unit is configured to compute a control parameter that is used by the control unit in order to control the image forming unit, with reference to the analysis result and the printing condition stored in the storage unit.

Further features of the present invention will become apparent from the following description of exemplary embodiments (with reference to the attached drawings).

DESCRIPTION OF THE EMBODIMENTS

Figure 1:
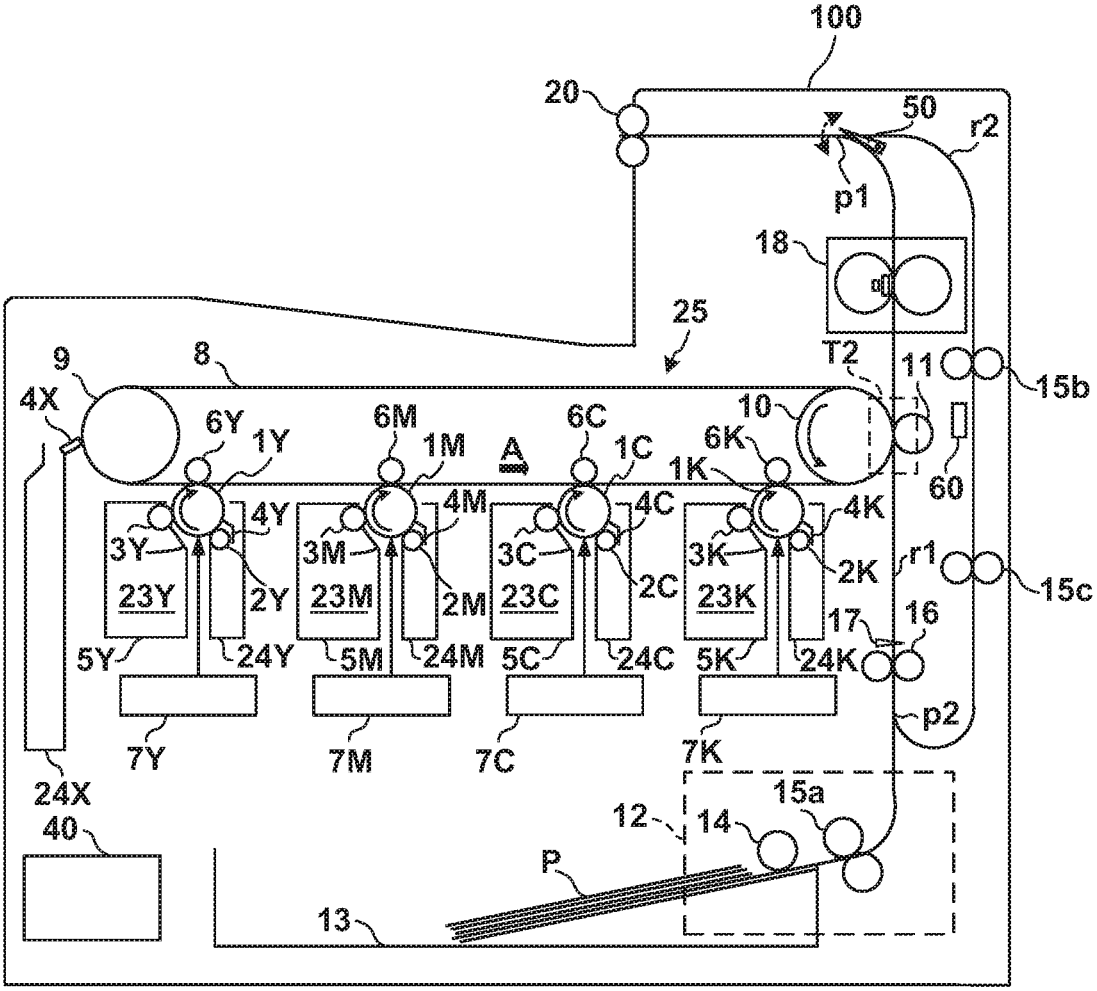
FIG. 1 is a diagram illustrating an image forming apparatus.

Hereinafter, embodiments will be described in detail with reference to the attached drawings. Note, the following embodiments are not intended to limit the scope of the claimed invention. Multiple features are described in the embodiments, but limitation is not made to an invention that requires all such features, and multiple such features may be combined as appropriate. Furthermore, in the attached drawings, the same reference numerals are given to the same or similar configurations, and redundant description thereof is omitted.

Embodiment 1

Image Forming Apparatus

FIG. 1 shows an image forming apparatus 100 employing an electrophotographic method that forms multicolor images. Process stations (process cartridges) 5Y, 5M, 5C and 5K are detachable from the image forming apparatus 100, and are a principal part of an image forming unit 25. The structures of the four process stations 5Y, 5M, 5C and 5K are the same, but the toner colors are different. YMCK that are appended to the end of the reference signs indicate the toner colors yellow, magenta, cyan and black. Except in the case of describing specific process stations, these characters YMCK will be omitted hereinafter. A toner container 23 is a container that holds toner. A photosensitive drum 1 is an image carrier that carries electrostatic latent images and toner images. A charging roller 2 uniformly charges the surface of the photosensitive drum 1. An exposure device 7 scans the surface of the photosensitive drum 1 with a laser beam according to the input image data, and forms an electrostatic latent image corresponding to the image data on the surface of the photosensitive drum 1. A developing roller 3 develops the electrostatic latent image by adhering toner that is held at the toner container 23 to the electrostatic latent image to form a toner image. A primary transfer roller 6 transfers the toner image that is carried on the photosensitive drum 1 to an intermediate transfer belt 8. The intermediate transfer belt 8 is supported in a tensioned state by a drive roller 9 and a counter roller 10, and is rotated in the direction of arrow A by the drive roller 9. The counter roller 10 is also driven rotationally by the rotation of the intermediate transfer belt 8. A cleaning blade 4 is a cleaning member that collects toner remaining on the surface of the photosensitive drum 1 in a collection container 24.

A feeding device 12 feeds sheets P to a main conveyance path r1. The main conveyance path r1 is a conveyance path extending from a feed cassette 13 to a reversal point p1. The feeding device 12, basically, feeds sheets so that there is a fixed interval between the leading sheet and the following sheet. This is due to the process stations 5 forming the image that is transferred to the leading sheet and the image that is transferred to the following sheet on the intermediate transfer belt 8 at a fixed interval. A feed roller 14 sends a sheet P that is loaded in the feed cassette 13 to a conveyance roller pair 15*a*. The conveyance roller pair 15*a* sends the sheet P to a resistance roller pair 16. The resistance roller pair 16 conveys the sheet P such that the timing at which the toner image that is conveyed by the intermediate transfer belt 8 reaches a secondary transfer unit T2 coincides with the timing at which the sheet P conveyed by the resistance roller pair 16 reaches the secondary transfer unit T2. For example, a controller 40 adjusts the rotation speed and the rotation restart time of the resistance roller pair 16 based on the timing at which the sheet P is detected by a sheet sensor 17.

A secondary transfer roller 11 transfers the toner image that is carried by the intermediate transfer belt 8 to the sheet P. The secondary transfer roller 11 and the intermediate transfer belt 8 form the secondary transfer unit T2. A cleaning blade 4X is a cleaning member that collects toner remaining on the surface of the intermediate transfer belt 8 in a collection container 24X after secondary transfer has ended. The sheet P sandwiched by the intermediate transfer belt 8 and the secondary transfer roller 11 is sent to a fixer 18. The fixer 18 fixes the toner image to the sheet P by applying heat and pressure to the sheet P and the toner image. The sheet P that has completed image formation is guided to a discharge roller pair 20 from the main conveyance path r1 by a flapper 50. The discharge roller pair 20 discharges the sheet P to a discharge tray.

In the case of forming an image on the second side of the sheet P, the controller 40 rotates the discharge roller pair 20 in reverse and switches the flapper 50. The back and front of the sheet P are thereby reversed due to the conveyance direction of the sheet P being reversed. The flapper 50 guides the sheet P to a sub-conveyance path r2. The sub-conveyance path r2 is a conveyance path that exists from the reversal point p1 to a junction point p2. On the sub-conveyance path r2, the sheet P is conveyed by conveyance roller pairs 15*b* and 15*c*. On the main conveyance path r1, the junction point p2 is provided upstream of the resistance roller pair 16. The sheet P is thus passed to the resistance roller pair 16 again. The sheet P whose conveyance timing has been adjusted by the resistance roller pair 16 is conveyed to the secondary transfer unit T2. A toner image is transferred to the second side of the sheet P, due to the second side contacting the intermediate transfer belt 8. The fixer 18 fixes the toner image to the second side of the sheet P. The flapper 50 guides the sheet P that has completed double-sided printing to the discharge roller pair 20. The sheet P on which images are formed on both sides is thereby discharged to the discharge tray. Note that an image sensor 60 that reads the surface of the sheet P is provided on the sub-conveyance path r2.

Fixer

Figure 2:
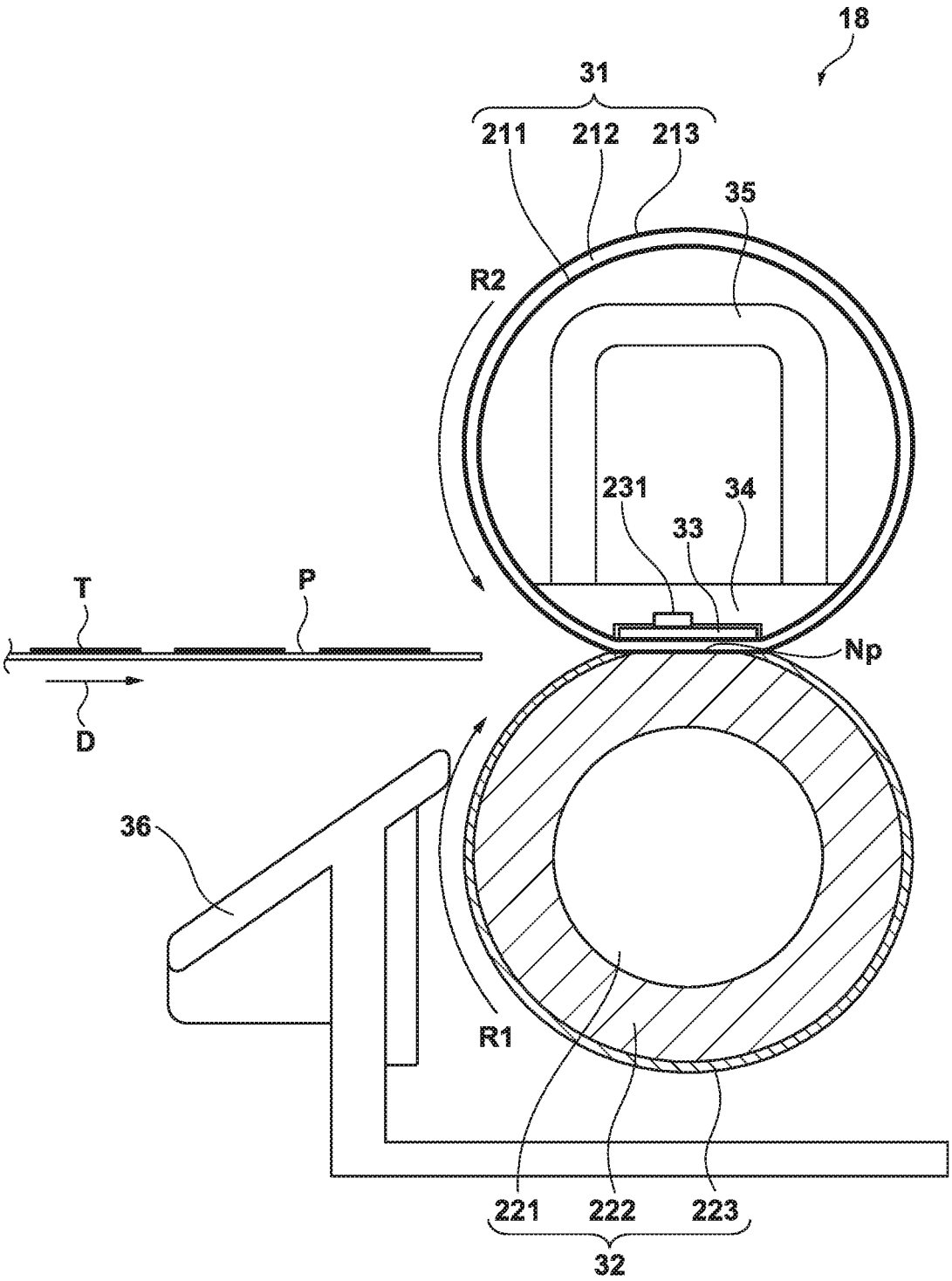
FIG. 2 is a diagram illustrating a fixer.

As shown in FIG. 2, the fixer 18 has a fixing film 31, a pressure roller 32, a heater 33, a heater holder 34, a pressure stay 35, and an entrance guide 36. The fixing film 31 is a member formed as an endless film, and is formed by layering a base layer 211, an elastic layer 212, and a surface layer 213. The elastic layer 212 is constituted by an elastic material having heat resistance such as silicone rubber, in order to improve fixability and achieve uniform glossiness. The surface layer 213 is constituted by a material with good mold-release characteristics (e.g., fluorocarbon resin having heat resistance, etc.), in order to improve the separability of the sheets P and to suppress offset of a toner image T. The thickness of the surface layer 213 decreases, according to the accumulated number of image formed sheets. Thus, the thickness of the surface layer 213 is designed according to the assumed lifetime of the fixer 18. The pressure roller 32 has an axial part 221, at least one elastic layer 222, and a surface layer 223. The elastic layer 222 is constituted by an elastic material (e.g., silicone rubber, fluorocarbon rubber, etc.) having heat resistance, in order to secure the width of a fixing nip Np. The surface layer 223 is constituted by a material with good mold-release characteristics having heat resistance (e.g., fluorocarbon resin), in order to prevent grime caused by toner or paper dust.

The heater 33 is a tabular heating element that rapidly heats the fixing film 31 while in contact with the inner peripheral side of the fixing film 31. A thermistor 231 detects the temperature of the heater 33. The thermistor 231 abuts the back surface of a substrate that holds the heater 33. Power that is supplied to the heater 33 is controlled such that the temperature of the heater 33 achieves a predetermined target temperature based on the detection signal of the thermistor 231.

The heater holder 34 is a holding member that holds the heater 33. The pressure stay 35 is constituted by a member having rigidity, and applies pressure received from a pressure member such as a spring to the pressure roller 32 via the heater holder 34. As a result of this pressure, the fixing nip Np having a predetermined width is formed between the fixing film 31 and the pressure roller 32.

The pressure roller 32 is driven by a drive source such as a motor and rotates in the direction of arrow R1. The fixing film 31 is driven and rotates in the direction of arrow R2 with the rotation of the pressure roller 32. The sheet P is guided along the entrance guide 36 to the fixing nip Np, in a state where the temperature of the heater 33 is controlled to be at a predetermined target temperature. The sheet P is sandwiched by the fixing film 31 and the pressure roller 32, and is conveyed in the direction of arrow D. In the conveyance process, heat and pressure are applied to the sheet P and the toner image T is fixed to the sheet P.

Controller

Figure 3:
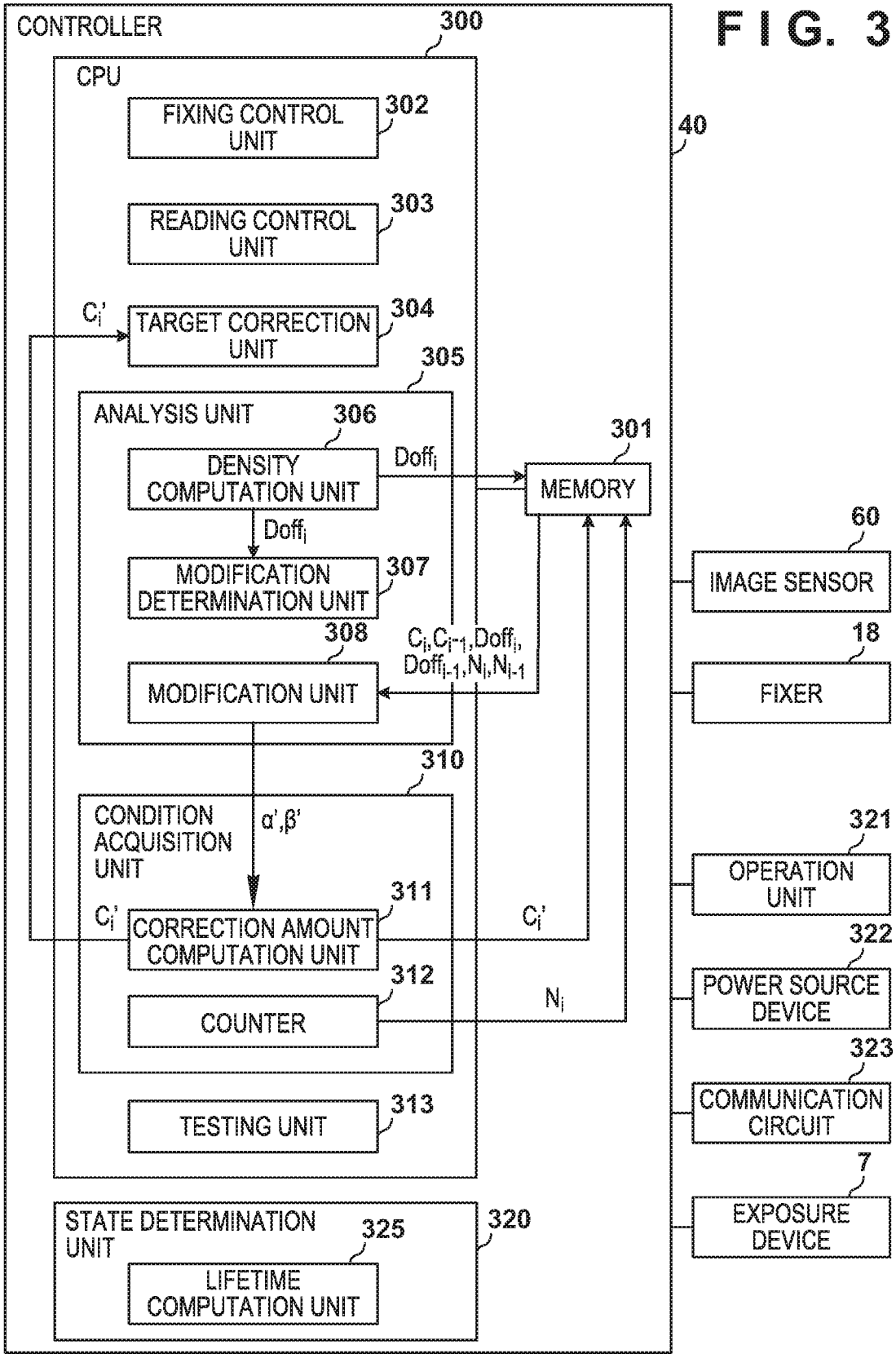
FIG. 3 is a diagram illustrating a controller.

As shown in FIG. 3, the controller 40 may have a CPU 300 and a memory 301. The CPU 300 realizes various functions by executing a control program stored in a ROM region of the memory 301. Some or all of these functions may be realized by a hardware circuit such as an ASIC and a FPGA. ASIC is short for Application Specific Integrated Circuit. FPGA is short for Field-Programmable Gate Array. The memory 301 may have a storage device such as a ROM, a RAM, a solid-state drive, and a hard disk drive.

A fixing control unit 302 controls power that is supplied to the heater 33 such that the temperature measured by the thermistor 231 approaches a target temperature decided by a target correction unit 304. A reading control unit 303 controls the image sensor 60 and acquires a reading result from the image sensor 60. The reading control unit 303 controls the flapper 50 and the discharge roller pair 20, and guides the sheet P to the sub-conveyance path r2. The reading control unit 303 controls the image sensor 60 to read a test image formed on the sheet P. The target correction unit 304 corrects the target temperature using a correction amount Ci or Ci' decided by a correction amount computation unit 311, and sets the target temperature in the fixing control unit 302.

An analysis unit 305 analyzes the reading result of the sheet P acquired by the image sensor 60, in order to ascertain the deterioration state of the fixing film 31. For example, a density computation unit 306 computes an offset density Doff based on the reading result of the sheet P. The offset density Doff is a parameter for correlating with the deviation in a prediction equation for predicting or computing the degree of deterioration/wear of the fixing film 31, or the correction amount Ci. A modification determination unit 307 determines whether the prediction equation needs to be modified by comparing the offset density Doff with a threshold value Dlim. In the case where the prediction equation needs to be modified, a modification unit 308 reads out the image analysis results and printing conditions that are stored in the memory 301, and modifies the prediction equation. For example, the modification unit 308 modifies the prediction equation by deriving a coefficient of the prediction equation.

A condition acquisition unit 310 acquires condition information such as printing conditions, and stores the acquired condition information in the memory 301. Condition information is information that can be ascertained by the image forming apparatus 100, such as printing conditions at the time of image formation, state information of members, detection values of various sensors provided in the image forming apparatus 100 and control parameters, for example. Printing conditions are information relating to setting of the image forming apparatus 100 at the time of printing, such as print mode (e.g., monochrome/color) and sheet size (e.g., A4, LTR), for example. The state information of members is information relating to the lifetime and use amount of members, such as the operating amount (number of images formed or operating hours) of the image forming apparatus 100, the process stations 5 or the fixer 18, for example. Detection values of the various sensors include, for example, temperature and humidity detected by an environmental sensor, the surface properties and thickness of the sheet P detected by a media sensor, temperature information detected by the thermistor 231, and electric current information of the transfer unit detected by a current detection element. Control parameters include the correction amount Ci of the target temperature, transfer bias, development bias, charging bias, and light exposure. Hereinafter, for convenience of description, the printing conditions are a sheet count Ni (accumulated value) counted by a counter 312, and the correction amount Ci derived by the correction amount computation unit 311. A testing unit 313 controls the image forming apparatus 100 to form a test image on a sheet P. For example, the testing unit 313 supplies image data corresponding to a test image to the exposure device 7. A state determination unit 320 determines the state of members constituting the image forming apparatus with reference to the stored analysis results and printing conditions. The state determination unit 320 may have a lifetime computation unit 325, for example. The lifetime computation unit 325 computes a value (e.g., remaining lifetime, ratio of remaining lifetime to entire lifetime) relating to the lifetime of a member (e.g., fixer 18) that is used in the image forming apparatus 100.

An operation unit 321 has a display device that provides information to the user, and an input device that receives user instructions. A power source device 322 is a power source device that generates development bias to be applied to the developing roller 3. A communication circuit 323 is a communication circuit that communicates with external devices (e.g., server, etc.).

Objective of Correcting Target Temperature

Since the fixing film 31 is a member that applies heat in direct contact with the sheet P and the toner image T, it is assumed that the surface temperature of the fixing film 31 is maintained at an appropriate target temperature. The fixing control unit 302 is able to maintain the temperature of the heater 33 at a constant temperature by feeding back the temperature detected by the thermistor 231. However, the temperature of the fixing film 31 that is heated by the heater 33 does not match the temperature of the heater 33. This is because the fixing film 31 has heat resistance, and, moreover, this heat resistance changes according to the operating amount (amount of cumulative wear) of the fixing film 31.

The surface layer 213 of the fixing film 31 wears due to microscopic rubbing against the sheets P and paper dust. As a result, the thickness of the region of the surface layer 213 that is in contact with the sheets P decreases as the operating amount increases. In order to secure the mold-release characteristics of the surface layer 213, the surface layer 213 has few additives that improve heat conduction such as filler. Thus, heat resistance per unit thickness for the surface layer 213 is high compared with that of the base layer 211 and the elastic layer 212. The change in thickness of the surface layer 213 thus greatly affects the heat resistance of the fixing film 31 as a whole. In particular, the heat resistance of the fixing film 31 decreases with a reduction of the thickness of the surface layer 213.

When the heat resistance of the fixing film 31 decreases, the temperature of the fixing film 31 increases, even when the temperature of the heater 33 is maintained at a constant value. As a result, excessive heat will be applied to the toner image T, and part of the toner image T will adhere to the fixing film 31. The toner adhered to the fixing film 31 will be transferred to the sheet P and fixed after one rotation of the fixing film 31. In other words, the image from one rotation earlier will be formed at a position offset in the sub-scanning direction (conveyance direction of the sheet P). Such a phenomenon may be referred to as hot offset. In order to reduce hot offset, the CPU 300 accurately predicts the wear amount of the surface layer 213, and corrects the target temperature of the heater 33 based on the prediction result. Hot offset is thereby reduced due to the temperature of the fixing film 31 being maintained at a predetermined target temperature. Accordingly, accurately predicting the wear amount of the surface layer 213 impacts the correction accuracy.

Outline of Correcting Target Temperature

Figure 4:
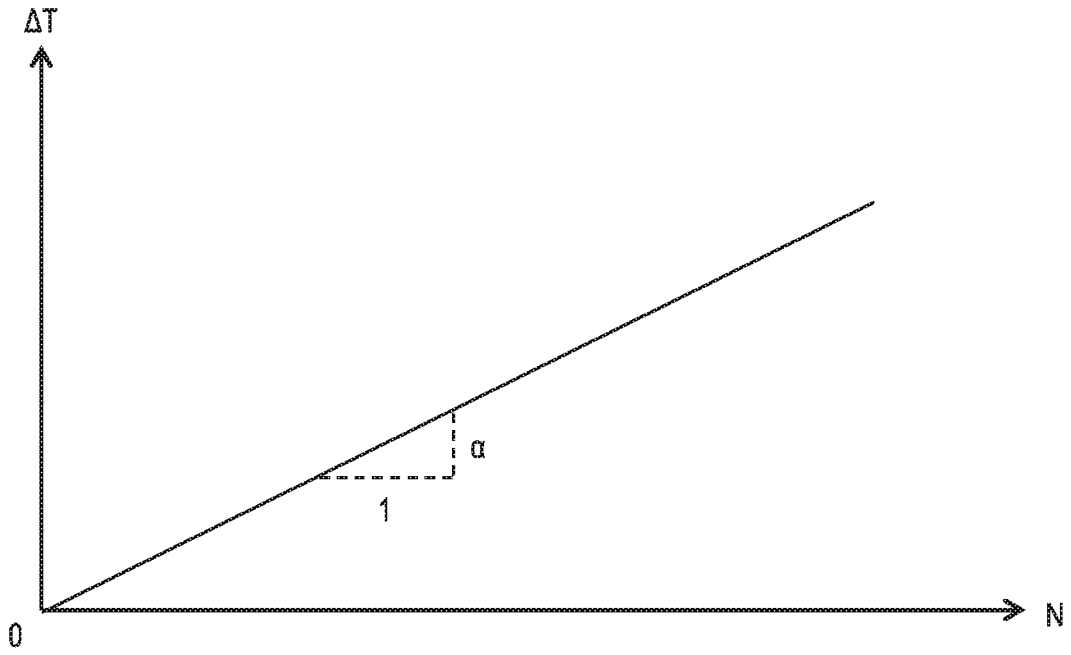
FIG. 4 is a diagram showing the relationship between operating amount and degree of temperature increase.

FIG. 4 shows the relationship between amount of temperature increase ΔT of the fixing film 31 and operating amount of the fixing film 31 (number N of sheets P that have passed through the fixer 18). The vertical axis shows the amount of temperature increase Δ. The horizontal axis shows the sheet count N. The amount of temperature increase ΔT represents an amount of increase in temperature of the fixing film 31 that is based on the temperature of the fixing film 31 when N=0 (i.e., when the fixing film 31 is unused). The sheet count N may be obtained by converting the size of the sheets P that are actually used into LTR size or A4 size. This is because a sheet P that is longer than A4 size erodes the fixing film 31 more than one sheet P of A4 size, for example.

As shown in FIG. 4, the amount of temperature increase ΔT and the sheet count N are postulated to have a linear relationship. The amount of temperature increase ΔT is the amount of increase relative to temperature T0 of the fixing film 31 when the sheet count N is 0. Thus, the amount of temperature increase ΔT is a linear function with an intercept at 0 and the sheet count N as a variable. As shown in FIG. 4, the amount of temperature increase ΔT of the fixing film 31 at the sheet count N can be represented with the following equation, where a is the slope of the linear function.

$$\Delta T = \alpha \times N \quad (1)$$

With the temperature range that is used in the fixing process, the variation width of the temperature of the heater 33 is in an approximately proportional relationship with the variation width of the temperature of the fixing film 31 corresponding thereto. Therefore, in order to maintain the temperature of the fixing film 31 at a constant value even when the fixing film 31 is worn, the target temperature of the heater 33 need only decrease according to the amount of temperature increase ΔT. Here, the correction amount for the target temperature of the heater 33 is defined as C. In other words, the target correction unit 304 acquires the corrected target temperature by subtracting the correction amount C from the target temperature. In this way, if the correction amount C is equal to the amount of temperature increase ΔT, the temperature of the fixing film 31 is maintained at a constant design value even when the fixing film 31 is worn. The correction amount computation unit 311 is able to compute the correction amount C using the following equation, where γ is a conversion coefficient for converting the amount of temperature increase ΔT into the temperature of the heater 33.

$$C=\gamma\times\Delta T \tag{2}$$

In this way, the target temperature is decreased by a correction amount αγN that is computed from equation (1) and equation (2). The slope α and the conversion coefficient γ are known values that are derived by simulation or testing at the time of shipment of the fixer 18. The slope α and the conversion coefficient γ are held in a ROM region of the memory 301, for example.

Improvement of Prediction Accuracy

If the image forming apparatus 100 is operating under the same operating conditions as the operating conditions of the fixing film 31 used in order to decide the slope α, the wear amount of the surface layer 213 increases according to the slope α. In this case, the amount of temperature increase ΔT is cancelled out by the correction amount C shown by equation (2), the temperature of the fixing film 31 is accurately corrected, and hot offset tends not to occur.

However, the wear amount of the surface layer 213 depends on the type of sheets P that are supplied and the temperature of the fixer 18. Paper with a high ash content and paper with high stiffness tend to wear the surface layer 213 more compared with normal paper. For example, such paper includes paper with a high content of calcium carbonate serving as filler and paper with a high basis weight. The surface layer 213 tends to wear more the higher the temperature of the fixing film 31. For example, in order to secure fixability, the target temperature of an environment in which the temperature of the sheets P is low (low temperature environment) is set higher than the target temperature for a normal environment. In other words, in a low temperature environment, the surface layer 213 tends to wear more.

In this way, the transition in the wear amount of the surface layer 213 of the fixing film 31 changes, depending on the type of sheets P and the environmental conditions (sheet conditions). Thus, the correction amount C that is computed based on the operating amount of the fixing film 31 can deviate from the correction amount that is actually needed.

Figure 5A:
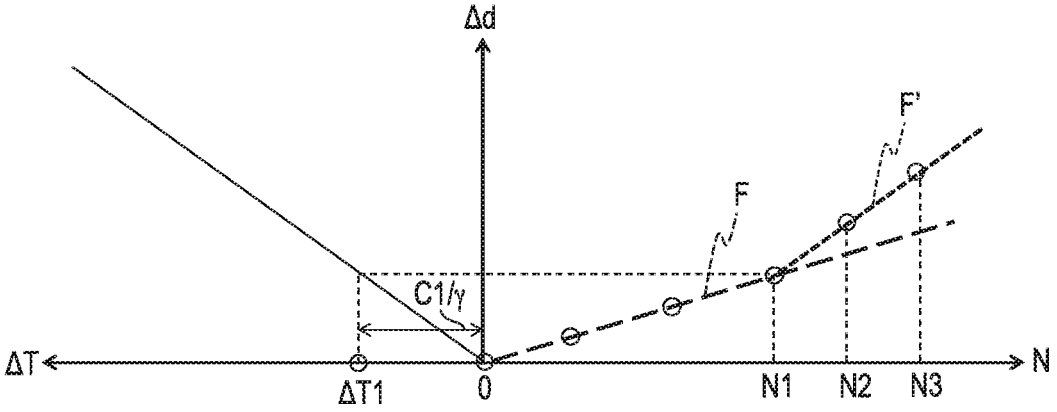
FIGS. 5A to 5C are diagrams showing the relationship between operating amount, degree of temperature increase and wear amount.
Figure 5B:
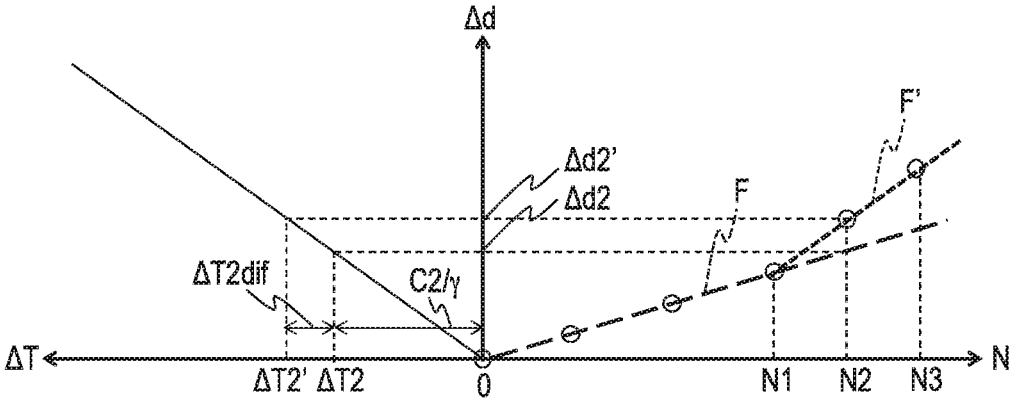
Figure 5C:
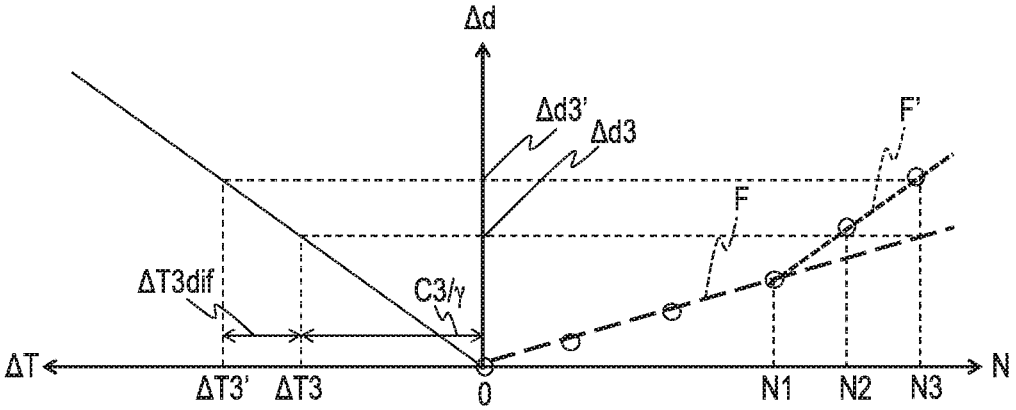

FIGS. 5A, 5B and 5C show an example in which prediction of the wear amount of the surface layer 213 deviates and offset occurs. In particular, even though prediction is initially correct from the start of use of the image forming apparatus 100, prediction deviates since the sheet conditions change from the assumed conditions during processing. The first quadrant indicates the relationship of the sheet count N and a wear amount Δd of the surface layer 213. This relationship is affected by the sheet conditions. In the present embodiment, it is shown that the transition in the wear amount Δd changes due to a change in the sheet conditions at a sheet count N1. The second quadrant shows the relationship between wear amount Δd and amount of temperature increase ΔT. This relationship is dependent on the change in heat resistance of the fixing film 31. Thus, this relationship is determined by the configuration of the fixer 18 including the fixing film 31, and is not affected by the sheet conditions.

N=0 to N1

The behavior in the section from the sheet count 0 to N1 will be described using FIG. 5A. In this section, the wear amount Δd transitions along a straight line F of the first quadrant. The heat conductivity of the fixing film 31 increases with an increase in the wear amount Δd (reduction of the thickness of the surface layer 213). The amount of temperature increase ΔT increases according to the relationship shown in the second quadrant.

The amount of temperature increase in the temperature of the fixing film 31 when the sheet count is N1 is defined as ΔT1 and the correction amount is defined as C1. The CPU 300 adjusts the target temperature of the heater 33 at the sheet count N1 to be lower by the correction amount C1 with respect to the target temperature at the sheet count 0. When the correction amount C1 is applied, the temperature of the fixing film 31 decreases by ΔT1 (=C1/γ). As a result, the amount of temperature increase ΔT1 corresponding to the wear amount Δd is cancelled out by C1/γ that is based on the correction amount C1. Therefore, in the section in which the sheet count is from 0 to N1, the temperature of the fixing film 31 is appropriately corrected, and thus hot offset does not occur.

N≥N1

The section in which the sheet count is greater than or equal to N1 will be described using FIGS. 5B and 5C. In this section, the wear amount Δd changes along a straight line F' in the first quadrant, due to a change in the sheet conditions or the like. The slope of the straight line F' is greater than the assumed slope of the straight line F. The actual wear amount at a sheet count N2 is Δd2', the assumed wear amount is Δd2, the actual amount of temperature increase of the fixing film 31 is ΔT2', and the assumed amount of temperature increase is ΔT2. The actual wear amount Δd2' that transitions along the straight line F' will be greater than the assumed wear amount Δd2 that transitions along the straight line F. As a result, the actual amount of temperature increase ΔT2' will be greater than the assumed amount of temperature increase ΔT2.

The correction amount of the target temperature of the heater 33 at the sheet count N2 is defined as C2. The target temperature of the heater 33 at the sheet count N2 is adjusted to be lower than the target temperature of the heater 33 at the sheet count 0 by the correction amount C2. The temperature of the fixing film 31 decreases by C2/γ due to the correction amount C2. As a result, the actual amount of temperature increase is ΔT2', but the target temperature is reduced by only ΔT2 (=C2/γ) when the correction amount C2 is used. Therefore, the temperature of the fixing film 31 at the sheet count N2 will be higher than the appropriate temperature by ΔT2dif which is the difference ΔT2'−ΔT2, and hot offset will occur.

According to FIG. 5C, the wear amount at a sheet count N3 which is larger than the sheet count N2 is Δd3', the assumed wear amount is Δd3, the actual amount of temperature increase is ΔT3', the assumed amount of temperature increase is ΔT3, and the correction amount is C3. The actual wear amount Δd3' which transitions along the straight line F' is larger than the assumed wear amount Δd3 which transitions along the straight line F. Furthermore, the difference between the wear amounts Δd3' and Δd3 at the sheet count N3 is greater than the difference at the sheet count N2. As a result, ΔT3dif which is the difference between the amounts of temperature increase ΔT3'−ΔT3 will be greater than ΔT2dif. Therefore, at the sheet count N3, hot offset occurs more markedly than at the sheet count N2.

When the transition in the wear amount of the surface layer 213 departs from the assumed wear amount, accurately reducing hot offset becomes difficult. Accordingly, it is necessary to modify the target temperature or the prediction equation of the correction amount according to the transition in the actual wear amount. For example, the CPU 300 reads and analyzes actual output images using the image sensor 60, and derives the offset density Doff representing the occurrence level of hot offset. Furthermore, the CPU 300 ascertains current transition in the wear amount from the offset density Doff and condition information associated therewith, and modifies the prediction equation.

Relationship Between Temperature of Fixing Film 31 and Offset Density

In order to derive an equation for modifying the prediction equation for obtaining the correction amount from the offset density Doff, the relationship between temperature of the fixing film 31 and offset density Doff will be required in advance.

Figure 6A:
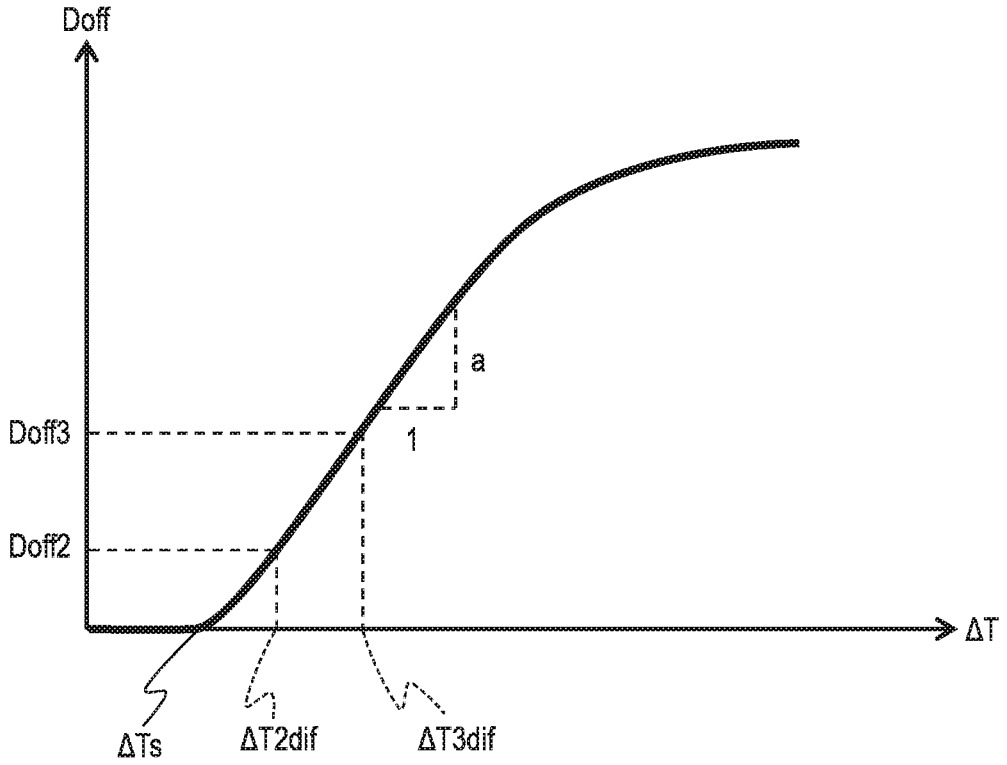
FIGS. 6A and 6B are diagrams respectively showing the relationship of offset density with degree of temperature increase and operating amount.

FIG. 6A shows the relationship between amount of temperature increase ΔT and offset density Doff. The horizontal axis shows the amount of temperature increase ΔT. The vertical axis shows the offset density Doff. This relationship is determined by the configuration of the fixer 18 including the fixing film 31, the toner and the like, and is not affected by the sheet conditions. ΔTs is the amount of temperature increase at which hot offset starts to occur, and indicates the margin with respect to the temperature of the fixing film 31 at an initial stage of operation of the fixer 18. The offset density Doff increases gradually when the amount of temperature increase ΔT exceeds the offset margin temperature ΔTs. The offset density Doff cannot exceed density of the toner image that serves as the basis of the offset. Thus, the offset density Doff converges to a predetermined value.

Even though a nonlinear portion exists in the relationship shown in FIG. 6A, the linear portion is taken into consideration in the present embodiment. This is because, in the present embodiment, the correction amount obtained from the abovementioned prediction equation is applied, and thus the range of the amount of temperature increase ΔT that actually occurs is also contained within the linear portion. In other words, it is approximated that the offset density Doff and the amount of temperature increase ΔT are substantively in a linear relationship. The offset density Doff with respect to the amount of temperature increase ΔT is derived from the following equation, where a is the slope.

$$Doff = a \times (\Delta T - \Delta Ts) \quad (3)$$

Note that Doff=0 when ΔT≤ΔTs. The slope a and the amount of temperature increase ΔTs are known constants that are derived by testing or simulation.

As described using FIG. 5C, the amount of temperature increase at the sheet count N2 is ΔT2dif, and the amount of temperature increase at the sheet count N3 is ΔT3dif. The offset densities of hot offset that respectively occurs occur at the sheet counts N2 and N3 are defined as Doff2 and Doff3. According to equation (3), the offset densities Doff2 and Doff3 are derived from the following equations.

$$Doff2 = a \times (\Delta T2dif - \Delta Ts) \quad (4)$$

$$Doff3 = a \times (\Delta T3dif - \Delta Ts) \quad (5)$$

In this way, the actual ΔT2dif and ΔT3dif can be derived, as long as the offset densities Doff2 and Doff3 can be measured. In other words, ΔT2dif and ΔT3dif which are the deviation amounts of the actual ΔT2' and ΔT3' with respect to ΔT2 and ΔT3 predicted based on the original prediction equations can be respectively computed.

Transition in Offset Density

Figure 6B:
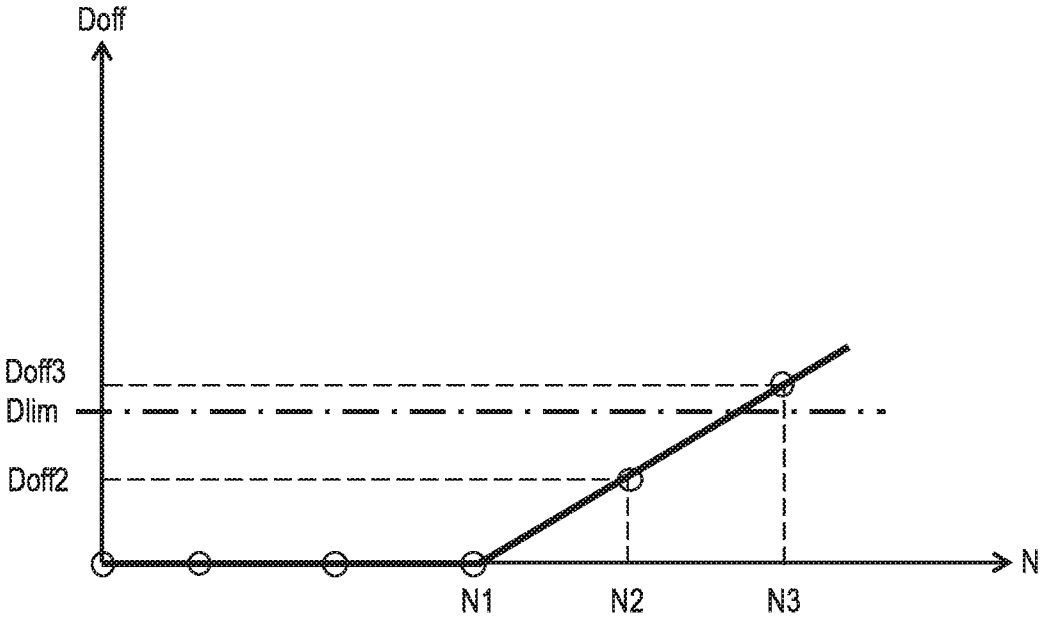

FIG. 6B shows the relationship between offset density Doff and sheet count N. The horizontal axis is the sheet count N. The vertical axis is the offset density Doff. In the section where the sheet count N is from 0 to N1, correction of the target temperature functions as expected, and thus the offset density Doff is zero.

On the other hand, in the section where the sheet count is greater than or equal to N1, the deviation amount in the amount of temperature increase increases to ΔT2dif and ΔT3dif as the sheet count N increases to N2 and N3, even when the target temperature is corrected. As a result, the offset density also increases to Doff2 and Doff3, and hot offset becomes manifest. In the present embodiment, a permissible limit value Dlim is provided for the offset density Doff. The permissible limit value Dlim is the maximum value of the permissible offset density Doff. Hot offset is not detected by the human eye if the occurrence is limited. Accordingly, the permissible limit value Dlim is set, in order to permit hot offset that is not harmful. In the case where the offset density Doff exceeds the permissible limit value Dlim, the CPU 300 modifies the prediction equation. In FIG. 6B, when the sheet count reaches N3, it is determined that the offset density Doff has exceeded the permissible limit value Dlim for the first time, and the prediction equation is modified.

Image Analysis and Acquisition Method of Condition Information

In order to modify the prediction equation, condition information including the offset density Doff, the sheet count associated therewith and the correction amount is required. Hereinafter, image analysis for deriving the offset density Doff and the acquisition method of condition information will be described.

Figure 7A:
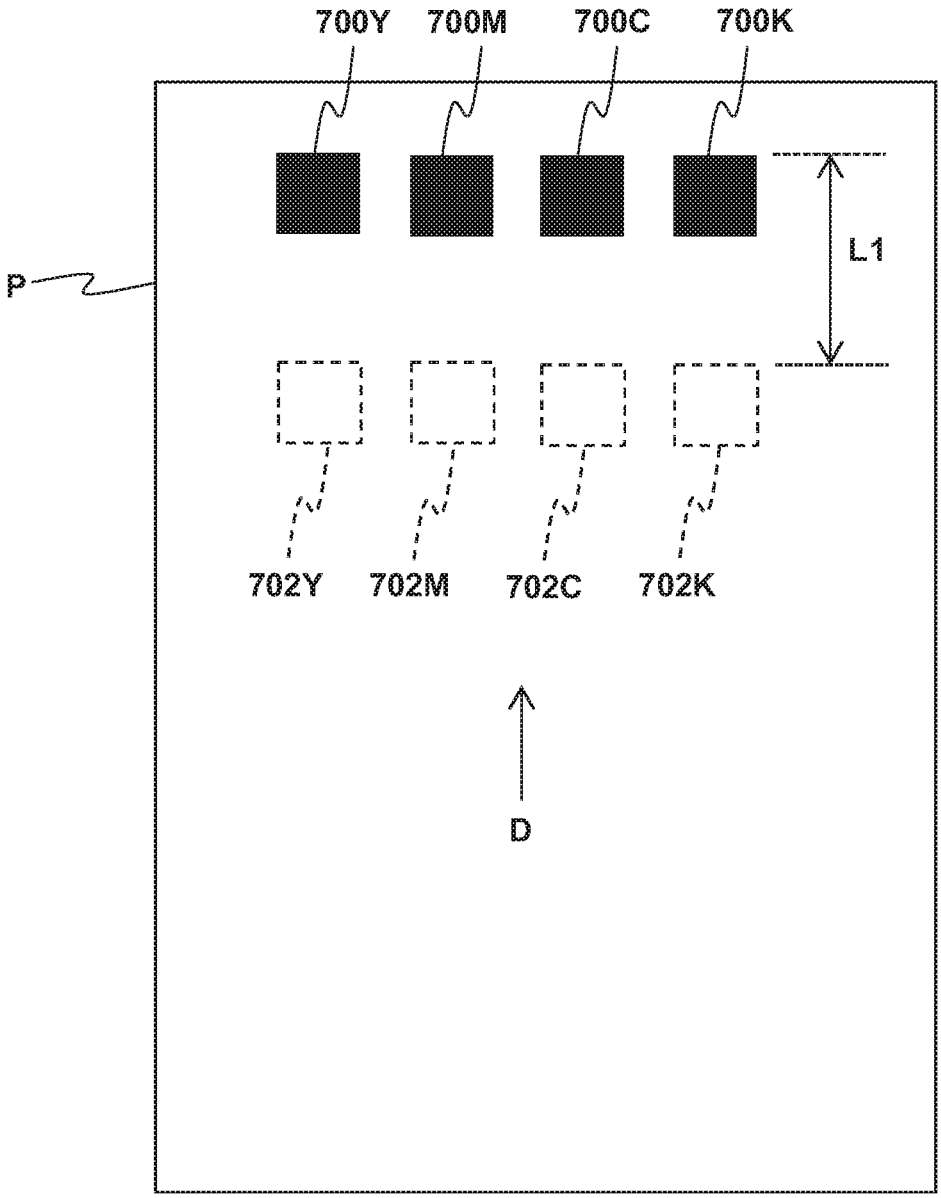
FIGS. 7A and 7B are diagrams illustrating a test image and stored data.

The image forming apparatus 100 outputs a test image, in order to measure the offset density Doff, reads the test image with the image sensor 60, and analyzes the state of the image with the analysis unit 305. FIG. 7A shows a test image 700 formed on a sheet P. Arrow D shows the conveyance direction of the sheet P. The test image 700 formed on the sheet P is a toner image formed at a predetermined density, and is prepared for the colors Y, M, C and K. In the case where the tendency for hot offset to occur differs depending on the toner color, the test image 700 may be formed for only the toner color with which hot offset is most likely to occur. In a situation where hot offset occurs, the hot offset appears in an offset region 702 that is on the downstream side in the conveyance direction at a distance L1 from the region in which the test image 700 was formed. Here, the distance L1 is equal to the peripheral length of the fixing film 31. The CPU 300 conveys the sheet P on which the test image 700 is fixed to the image sensor 60, and causes the image sensor 60 to read the test image 700. The analysis unit 305 extracts the image data of the offset region 702 from the image data generated by the image sensor 60. Since the region of the test image 700 on the sheet P and the distance L1 are known, the position of the offset region 702 in the image data acquired from the sheet P is also known. The analysis unit 305 converts the plurality of pixel signals constituting the image data of the offset region 702 into brightness information. The analysis unit 305 calculates an offset density Doff that is represented by the difference between the brightness of the offset region 702 and the brightness of a non-image part (sheet surface), and outputs the calculated offset density Doff as an analysis result. The non-image part is a region on the sheet P in which neither a toner image nor hot offset is formed. Since the position of the non-image part on the sheet P is known, the analysis unit 305 is able to acquire the brightness of the non-image part (sheet surface) from the image data acquired from the sheet P.

Figures 7B, 8:
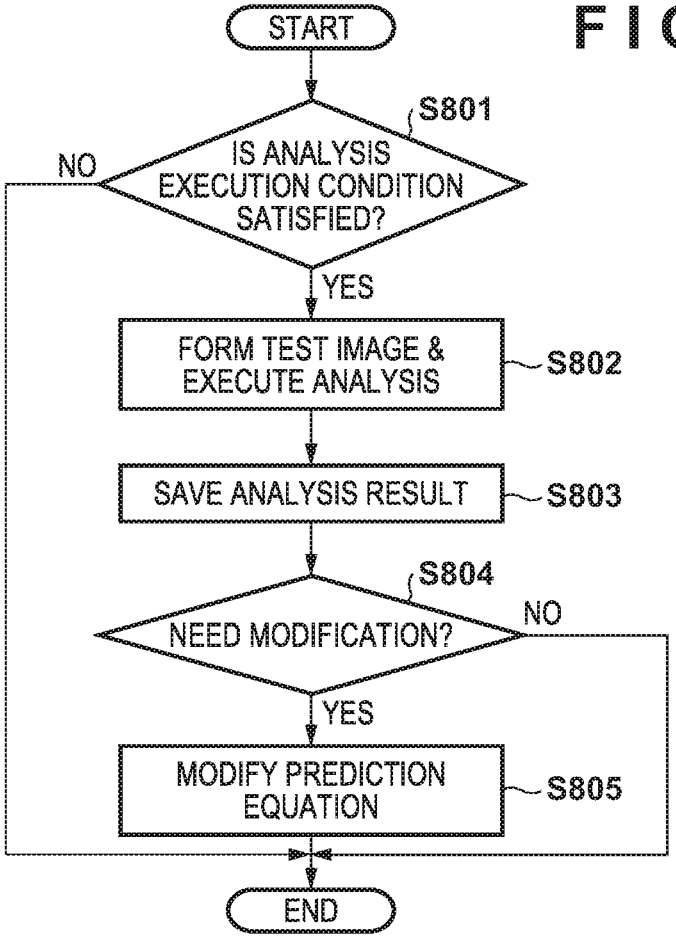
FIG. 8 is a flowchart showing a modification method.

As shown in FIG. 7B, the analysis unit 305 saves the offset density Doff to the memory 301 in association with condition information from when the test image 700 was formed on the sheet P. In the present embodiment, the condition information required in modification of the prediction equation is the sheet count N and the correction amount C. The offset density Doff, the sheet count N and the correction amount C are stored in the memory 301, whenever image analysis is executed.

Modification Method of Prediction Equation

FIG. 8 is a flowchart showing a method of modifying the prediction equation that is executed by the CPU 300. The CPU 300 executes the following processing whenever one print job ends, for example.

In step S801, the CPU 300 determines whether an analysis execution condition is satisfied. For example, the analysis execution condition is that ΔNi which is the difference between the operating amount when image analysis was executed last time (sheet count Ni−1) and the operating amount this time (sheet count Ni) is greater than or equal to a threshold value Nth. Note that the analysis execution condition may be that analysis is instructed through the operation unit 321. If the analysis execution condition is not satisfied, the CPU 300 ends the modification method. If the analysis execution condition is satisfied, the CPU 300 advances to step S802.

In step S802, the CPU 300 forms a test image on the sheet P, and analyzes the test image. For example, the testing unit 313 controls the image forming apparatus 100 to form the test image 700 on the sheet P. The testing unit 313 controls the discharge roller pair 20 and the flapper 50, and conveys the sheet P to the sub-conveyance path r2. The testing unit 313 controls the conveyance roller pairs 15*b* and 15*c*, and conveys the sheet P such that the image sensor 60 can read the sheet P on which the test image 700 is formed. The reading control unit 303 controls the image sensor 60 to read the sheet P and generate image data, and saves the generated image data to the memory 301. The density computation unit 306 of the analysis unit 305 computes the offset density Doff from the image data.

In step S803, the CPU 300 saves the analysis result to the memory 301. For example, the density computation unit 306 of the analysis unit 305 saves the offset density Doffi, the sheet count Ni and the correction amount Ci to the memory 301 in association with each other.

In step S804, the CPU 300 determines whether the prediction equation needs to be modified based on the offset density Doffi. For example, the modification determination unit 307 may determine whether the offset density Doff is greater than or equal to the permissible limit value Dlim. The offset density Doff being greater than or equal to the permissible limit value Dlim indicates that the prediction equation has deviated from the actual situation. If the offset density Doff is not greater than or equal to the permissible limit value Dlim, the CPU 300 ends the modification method. If the offset density Doff is greater than or equal to the permissible limit value Dlim, the CPU 300 advances to step S805.

In step S805, the CPU 300 modifies the prediction equation based on the offset density Doffi. For example, the modification unit 308 modifies the prediction equation based on the previous offset density Doffi−1, sheet count Ni−1 and correction amount Ci−1 and the current offset density Doffi, sheet count Ni and correction amount Ci.

Equation for Modifying Prediction Equation

Figure 9A:
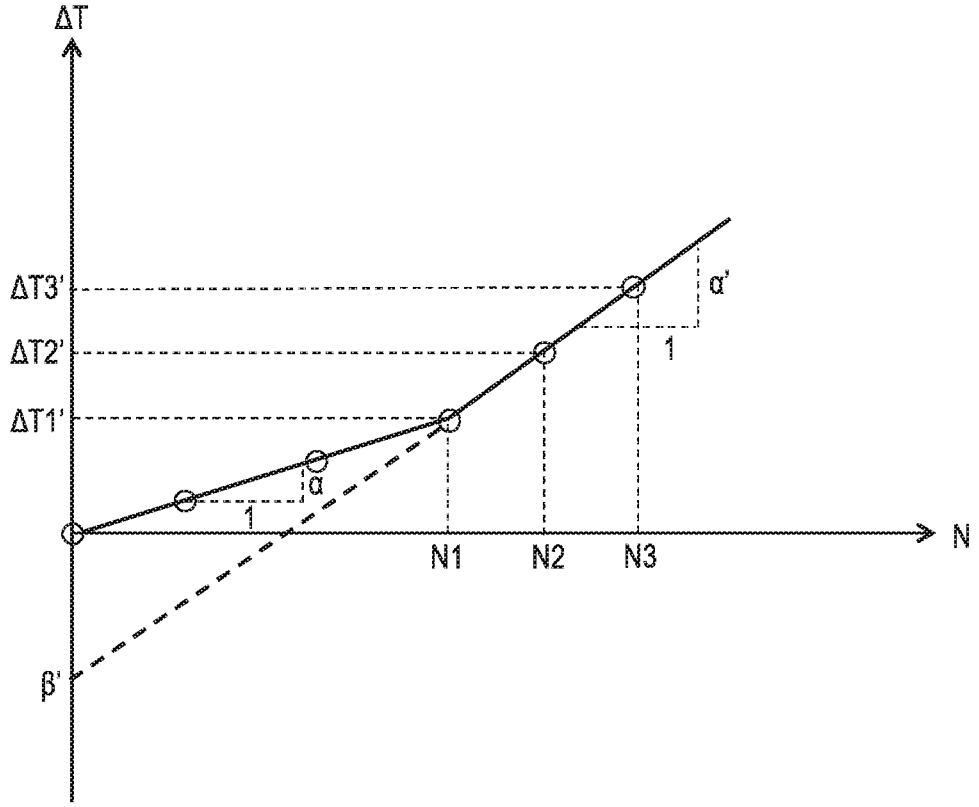
FIGS. 9A and 9B are diagrams showing the relationship between operating amount, degree of temperature increase and wear amount.

FIG. 9A is a diagram showing the relationship between amount of temperature increase ΔT and sheet count N. The amount of temperature increase from the sheet count N1 where transition in the wear amount Δd of the surface layer 213 changes from before the sheet count N1 is ΔT', the slope is α', and the intercept is defined as β'. The relationship between amount of temperature increase ΔT' and sheet count N is represented by the following equation.

$$\Delta T' = \alpha' \times N + \beta' \tag{6}$$

The modified new correction amount is given as C'. If the correction amount C' is equal to the actual amount of temperature increase ΔT', hot offset does not occur. Therefore, the prediction equation for computing the correction amount C' is obtained by substituting equation (6) into equation (2).

$$\begin{aligned} C' &= \gamma \times \Delta T' \\ &= \gamma(\alpha' \times N + \beta') \end{aligned} \tag{7}$$

Here, as mentioned above, the conversion coefficient γ is a known constant. Modifying the prediction equation according to the current state of the fixing film 31 is equivalent to deriving α' and β' of equation (7). The unknown constants α' and β' are derived based on a set of two or more of the offset density Doff, the sheet count N associated therewith, and the correction amount C prior to modification. Here, the constants α' and β' are computed, based on information associated with the sheet count N2 and information associated with the sheet count N3.

According to the equation (6), the amount of temperature increase ΔT2' associated with the sheet count N2 and the amount of temperature increase ΔT3' associated with the sheet count N3 can be represented respectively by the following equations.

$$\Delta T2' = \alpha' \times N2 + \beta' \tag{8}$$

$$\Delta T3' = \alpha' \times N3 + \beta' \tag{9}$$

On the other hand, the offset density Doff2 associated with the sheet count N2 is derived from substituting equation (2) into equation (4).

$$\begin{aligned} Doff2 &= a \times (\Delta T2dif - \Delta Ts) \\ &= a \times (\Delta T2' - \Delta T2 - \Delta Ts) \\ &= a \times (\Delta T2' - C2/\gamma - \Delta Ts) \end{aligned} \tag{10}$$

Similarly, the offset density Doff3 associated with the sheet count N3 is derived from equations (5) and (2).

$$Doff3 = a \times (\Delta T3dif - \Delta Ts) \quad (11)$$
$$= a \times (\Delta T3' - \Delta T3 - \Delta Ts)$$
$$= a \times (\Delta T3' - C3/\gamma - \Delta Ts)$$

Here, the following equation is obtained by substituting equation (8) into equation (10).

$$Doff2 = a \times \{(\alpha' \times N2 + \beta') - C2/\gamma - \Delta Ts\} \quad (12)$$
$$= [a \times \alpha'] \times N2 + [a \times (\beta' - C2/\gamma - \Delta Ts)]$$

Similarly, the offset density Doff3 is represented by the following equation, by substituting equation (9) into equation (11).

$$Doff3=[a\times\alpha']\times N3+[a\times(\beta'-C3/\gamma-\Delta Ts)] \quad (13)$$

The offset density Doff that is represented by equations (12) and (13) is a linear function with the sheet count N counted with the counter 312 as a variable. Here, the slope a of the offset density Doff, the correction amounts C2 and C3, the offset margin temperature ΔTs and the conversion coefficient γ are known constants. Since there are two unknown variables α' and β', the slope α' and the intercept β' can be derived, as long as there are at least two equations of the offset density Doff with the sheet count N as a variable. For example, the following equations are obtained when equations (12) and (13) are regarded as two-dimensional simultaneous equations.

$$\beta'=-N2\times\alpha'+K \quad (14)$$

$$K=Doff2/a+C2/\gamma+\Delta Ts \quad (15)$$

$$\beta'=-N3\times\alpha'+L \quad (16)$$

$$L=Doff3/a+C3/\gamma+\Delta Ts \quad (17)$$

$$\alpha'=(L-K)/(N3-N2) \quad (18)$$

$$\beta'=(K\times N3-L\times N2)/(N3-N2) \quad (19)$$

The modification unit 308 computes the intercept β' from equation (19). Also, the modification unit 308 computes the slope α' from equation (18). Here, although the prediction equation is modified using the offset densities Doff2 and Doff3, α' and β' may be computed statistically from three or more offset densities Doff.

The correction amount computation unit 311 completes the modified prediction equation, by substituting α' and β' into equation (7). The correction amount computation unit 311 derives the correction amount C' modified using equation (7), and sets the derived correction amount C' in the target correction unit 304. The target correction unit 304 corrects the target temperature using the modified correction amount C'. Hot offset thereby becomes less likely to occur. The correction amount computation unit 311 saves the modified correction amount C'i to the memory 301 in association with the sheet count Ni and the offset density Doffi.

Second Embodiment

As described in the first embodiment, a constant relationship exists between the amount of temperature increase ΔT, and the wear amount Δd. Accordingly, the CPU 300 (lifetime computation unit 325) is able to compute the wear amount Δd from the amount of temperature increase ΔT. On the other hand, the thickness (initial thickness d) of the surface layer 213 of the unused fixing film 31 is known. When the thickness of the surface layer 213 reaches 0, the fixer 18 needs to be replaced. Accordingly, the lifetime computation unit 325 is able to compute the remaining lifetime of the fixing film 31 from the thickness of the surface layer 213 of the unused fixing film 31 and the wear amount Δd. For example, when the remaining lifetime decreases to less than or equal to a threshold value, the lifetime computation unit 325 may output a message prompting replacement of the fixer 18 to a display device of the operation unit 321. Since the user is thereby able to replace the fixer 18 before the fixer 18 becomes completely unusable, downtime is reduced. Downtime is the time when the user is not able to form images.

Figure 9B:
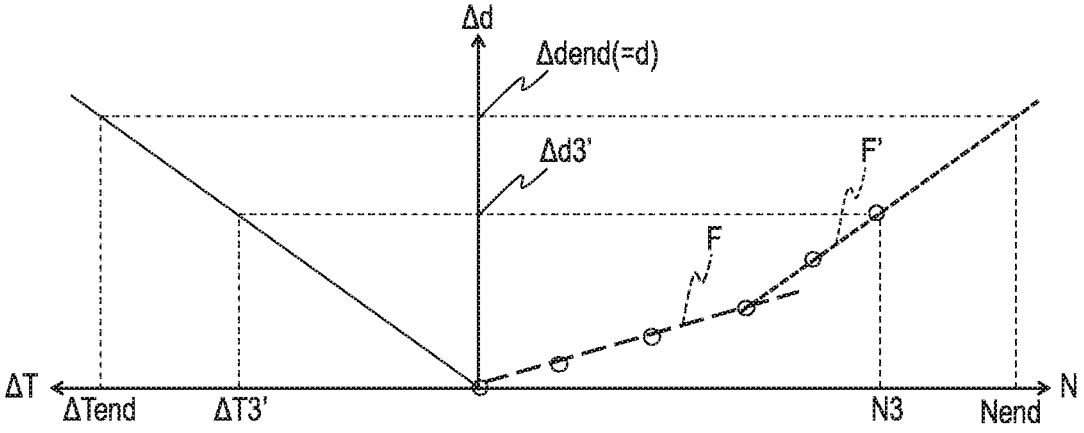

FIG. 9B is a diagram illustrating a method of predicting the lifetime of the fixer 18. The relationship between the sheet count N, the wear amount Δd of the surface layer 213 and the amount of temperature increase ΔT in FIG. 9B is as already described in relation to FIG. 5A. Here, prediction of the lifetime of the fixer 18 when the sheet count reaches N3 will be described as an example.

The timing at which the lifetime of the fixer 18 ends is the point in time at which the integrated value of the wear amount Δd becomes equal to the initial thickness d. The integrated value of the wear amount of the surface layer 213 at the timing at which the lifetime ends is defined as Δdend. Since the initial thickness d can be regarded as a design value, Δdend which is equal to the initial thickness d is a known value.

The amount of temperature increase at the timing at which the lifetime ends is defined as ΔTend. ΔTend is a known value that can be derived in advance from Δdend. This is because the relationship between wear amount Δd and amount of temperature increase ΔT shown in the second quadrant of FIG. 9B is determined by the configuration of the fixer 18, and is not affected by the sheet conditions which change with how the user uses the image forming apparatus 100.

On the other hand, ΔT3' can be calculated from the offset density Doff stored in the memory 301, the sheet count N associated therewith and the correction amount C, as described in the first embodiment. For example, the CPU 300 is able to calculate ΔT3', by deriving α' and β' to complete equation (9) and further substituting the sheet count N3 corresponding to ΔT3' into equation (9).

The wear amount Δd and the amount of temperature increase ΔT are in a proportional relationship. In view of this, the lifetime computation unit 325 may compute a ratio R [%] of the remaining film thickness to the initial thickness d of the surface layer 213 at the sheet count N3 using equation (20). The remaining film thickness may be referred to as the remaining lifetime.

$$R=\Delta T3'/\Delta Tend\times 100 \quad (20)$$

As another example of predicting the lifetime of the fixer 18, the lifetime computation unit 325 is also able to predict the number of sheets that can be fed until the timing at which the lifetime ends. As shown in FIG. 9B, the number of sheets that can be fed until the timing at which the lifetime ends is defined as Nend. The lifetime computation unit 325 derives Nend corresponding to ΔTend, using equation (21) obtained by transforming equation (6).

$$Nend=(\Delta Tend-\beta')/\alpha' \quad (21)$$

Here, the lifetime computation unit 325 may calculate a number ΔN of sheets that can be fed until the timing at which the lifetime ends that is based on the sheet count N3 using the following equation.

$$\Delta N = N\text{end} - N3 \quad (22)$$

In other words, the lifetime computation unit 325 may calculate ΔN that is equivalent to the remaining lifetime using equation (22). In this way, according to the second embodiment, the predictive accuracy of the lifetime of the fixer 18 improves by taking the current sheet conditions into consideration.

Third Embodiment

Figure 10:
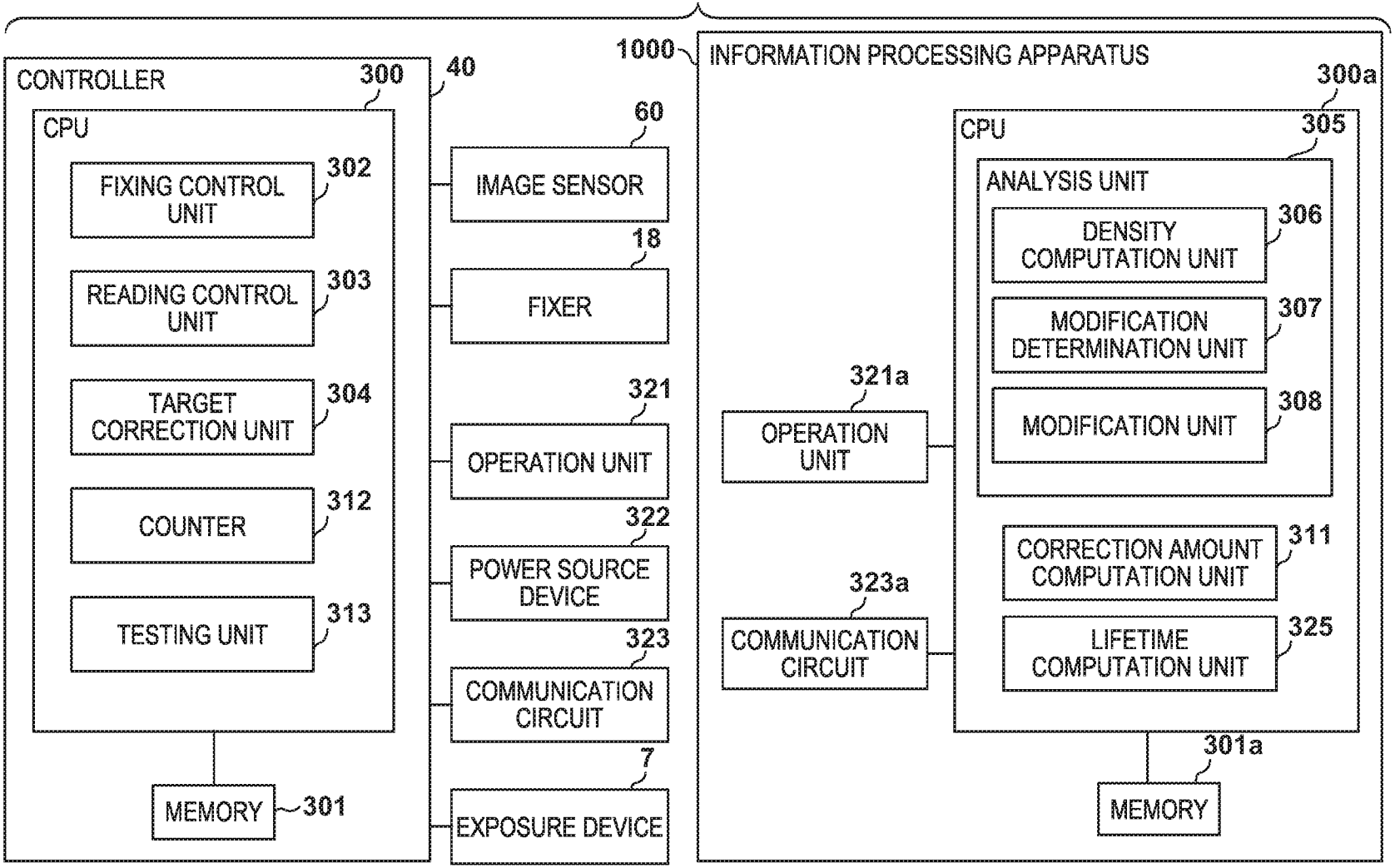
FIG. 10 is a diagram illustrating an image forming system that includes an information processing apparatus.

In first and second embodiments, all the computations relating to modification of the prediction equation are executed inside the image forming apparatus 100. However, this is not essential. As shown in FIG. 10, all or some of the computations relating to modification of the prediction equation may be executed by an information processing apparatus 1000.

In FIG. 10, the information processing apparatus 1000 is a computer that has a CPU 300*a*, a memory 301*a*, an operation unit 321*a*, and a communication circuit 323*a*. The communication circuit 323*a* communicates with the communication circuit 323 via a network (e.g., LAN, Internet). In other words, the CPU 300*a* is able to perform transmission and reception of commands and data with the CPU 300 of the image forming apparatus 100 via the communication circuit 323*a* and the communication circuit 323.

The testing unit 313, upon the count value of the counter 312 satisfying an execution start condition, causes the image forming apparatus 100 to form a test image, causes the image sensor 60 to read the test image, and transmits the image data of the test image to the information processing apparatus 1000. The CPU 300*a* has the abovementioned density computation unit 306, modification determination unit 307, modification unit 308, correction amount computation unit 311, and lifetime computation unit 325 (state determination unit 320). The functions thereof are as described in the first and second embodiments. The CPU 300*a*, upon receiving image data, uses these functions to compute the correction amount C' using the modified prediction equation, and transmit the correction amount C' to the image forming apparatus 100. The target correction unit 304 of the image forming apparatus 100 receives the correction amount C', and decides a new target temperature by subtracting the correction amount C' from the current target temperature.

In FIG. 10, the density computation unit 306, the modification determination unit 307, the modification unit 308, the correction amount computation unit 311, and the lifetime computation unit 325 (state determination unit 320) are provided in the information processing apparatus 1000. However, some of the functions thereof may be provided in the image forming apparatus 100. For example, in order to reduce the communication traffic between the communication circuit 323 and the communication circuit 323*a*, the density computation unit 306 may be provided in the image forming apparatus 100. This is because the data amount of the offset density Doff is much less compared with the data amount of image data.

By providing the functions relating to image analysis in the information processing apparatus 1000, as shown in FIG. 10, it should be possible to shorten the time required in image analysis and computation. This is premised on the computation capability of the CPU 300*a* of the information processing apparatus 1000 being higher than the computation capability of the CPU 300. In the case where machine learning such as deep learning is used in image analysis, a large amount of calculation will be required. In this case, it is greatly advantageous to use a computer that is external to the image forming apparatus 100.

The information processing apparatus 1000 may be connected to a plurality of image forming apparatuses 100. In this case, the information processing apparatus 1000 is able to provide an image analysis service to the plurality of image forming apparatuses 100. Also, the information processing apparatus 1000 is able to collectively manage the states of the plurality of image forming apparatuses 100.

Summary

Aspect 1

The analysis unit 305 functions as an analysis unit that analyzes a reading result acquired by a test image formed on a sheet P being read by the image sensor 60, and outputs an analysis result. The memories 301 and 301*a* function as a storage unit that stores printing conditions used when the test image was formed and the analysis result in association with each other. The CPU 300 functions as a computation unit that computes a control parameter (e.g., target temperature) that is used by a control unit in order to control an image forming unit, with reference to the analysis results and printing conditions stored in the storage unit. In this way, according to aspect 1, an image forming apparatus 100 that stores the printing conditions used when an image was formed and the reading result (analysis result) of the image in association with each other is provided. Also, the control parameter that is used by the control unit in order to control the image forming unit is derived, with reference to the analysis results and printing conditions stored in the storage unit. Since the transition in the state of the image forming apparatus 100 is known from the analysis results and printing conditions stored in the storage unit, the control parameter is thereby derived accurately.

Aspects 2 and 8

The control parameter that is calculated by the computation unit (e.g., CPU 300) may be a correction amount (correction amount of the target temperature) relating to control of the image forming unit that depends on the use amount of a member (e.g., fixer) constituting the image forming unit. The correction amount can thereby be derived accurately.

Aspect 3

The CPU 300 or the state determination unit 320 may function as a state determination unit that determines the state of a member (e.g., fixer) constituting the image forming unit with reference to the analysis results and printing conditions stored in the storage unit. Since the transition in the state of the image forming apparatus 100 (wear of the fixer) is known from the analysis results and printing conditions stored in the storage unit, the state of the member can be determined accurately.

Aspects 4 and 10

The state that is determined by the state determination unit (e.g., CPU 300 or lifetime computation unit 325) may be the remaining lifetime of a member constituting the image forming unit. Since the transition in the wear of the member can be accurately revealed from the analysis results and printing conditions stored in the storage unit, the remaining lifetime of the member can thereby be accurately derived.

Aspects 5 and 11

The printing conditions may also include at least one of the use amount of a member constituting the image forming unit or a control parameter of the member. The stored use amounts of the member indicate the transition in the use amount of the member. Also, the control parameter is corrected according to the state of the image forming apparatus 100 which changes from moment to moment. Accordingly, the control parameter also indirectly indicates the state of the image forming apparatus 100. Therefore, the use amount of the member or the control parameter of the member can serve as a measure indicating the transition in the state of the image forming apparatus 100.

Aspects 6 and 12

As described in relation to FIG. 8, the image forming unit may be configured to form a test image. Also, a reading unit may be configured to read the test image. In this case, the analysis unit is configured to analyze a reading result acquired by the test image being read by the reading unit and output an analysis result. The reliability of the analysis result improves due to analyzing an image determined in advance such as a test image. An image designated for printing by the user may, however, be taken as the analysis target instead of a test image. In this case, the advantage of a sheet required for analysis no longer being necessary arises in exchange for analysis accuracy.

Aspects 7 and 9

As described using FIG. 10, an image forming system that has the image forming apparatus 100 and an external device (e.g., information processing apparatus 1000) may be provided. In this case, the image forming unit, the control unit and the reading unit are provided in the image forming apparatus 100. On the other hand, the analysis unit is provided in one of the image forming apparatus and the external device. The storage unit is also provided in one of the image forming apparatus and the external device. The computation unit is also provided in one of the image forming apparatus and the external device. The state determination unit (e.g., lifetime computation unit 325) is also provided in one of the image forming apparatus and the external device. The load and hardware (capacity of storage device, etc.) of the image forming apparatus 100 can thereby be reduced.

Aspect 13

As shown in FIG. 1, the image forming unit 25 is an example of an image forming unit that forms an image on a sheet P. The counter 312 is an example of a measurement unit that measures the operating amount (e.g., sheet count) of the image forming unit. The CPU 300 and the correction amount computation unit 311 are examples of a computation unit that computes the correction amount of a control parameter (e.g., target temperature of the heater 33) by substituting the operating amount into a prediction equation of the correction amount (e.g., equation (7)). The target correction unit 304 functions as a correction unit that corrects the control parameter based on the correction amount. The CPU 300 and the fixing control unit 302 function as a control unit that controls the image forming unit based on the control parameter. The image sensor 60 functions as a reading unit that reads the sheet P. The CPU 300 and the modification determination unit 307 function as a determination unit that determines whether the prediction equation needs to be modified based on the result of reading of the sheet by the reading unit. The CPU 300 and the modification unit 308 function, when the determination unit determines that the prediction equation needs to be modified, as a modification unit that modifies the prediction equation based on the reading result of the sheet. The reading result of the sheet is correlated with how the user uses the image forming apparatus 100. Accordingly, the occurrence of image defects is reduced by modifying the prediction equation of the correction amount according to the reading result of the sheet.

Aspect 14

The CPU 300 and the testing unit 313, upon a predetermined determination execution condition being satisfied, control the image forming unit to form a test image on a sheet P, and cause the reading unit to read the test image formed on the sheet. The CPU 300 and the modification determination unit 307 determine whether the prediction equation needs to be modified based on the reading result of the test image. In this way, it becomes possible to determine whether the prediction equation needs to be modified more accurately, by using a test image.

Aspect 15

As illustrated in FIG. 7A, the reading result of the test image is the reading result of a region, on the sheet P, that is separated by a predetermined distance from the test image. This is because hot offset originating in the test image can occur in a region that is separated by a predetermined distance from the test image. In this way, the computation amount can be reduced by focusing on a specific region.

Aspect 16

As described in relation to step S801, the predetermined determination execution condition may be that the amount of increase in the operating amount (e.g., $\Delta N$) of the image forming unit has reached a given amount. This is because the image forming unit wears in correlation with the operating amount.

Aspect 17

The operating amount may be the number of images formed by the image forming unit (e.g., number of sheets fed to the fixer 18). This is because the image forming unit wears in correlation with the number of sheets fed to the image forming unit.

Aspect 18

As shown in FIG. 7B, the memory 301 functions as a recording unit that, upon a predetermined determination execution condition being satisfied, records the analysis result obtained from the reading result of the test image and printing conditions including the operating amount and the correction amount in association with each other. The CPU 300 and the modification unit 308 may modify the prediction equation based on information that is held in the recording unit. This information may, for example, include a first operating amount, a first correction amount associated with the first operating amount, and an analysis result associated with the first operating amount. Furthermore, this information may include a second operating amount, a second correction amount associated with the second operating amount, and an analysis result associated with the second operating amount. It thereby becomes possible to accurately modify the prediction equation.

Aspect 19

As shown by equation (7) and the like, the prediction equation may be a linear function with the operating amount as a variable. It thereby becomes possible to derive the correction amount with a simple computation. Note that the prediction equation is a computational equation for computing the correction amount, and can be referred to as a correction equation.

Aspect 20

As illustrated in equation (7), the linear function may have a first coefficient (e.g., $\alpha'$) with which the operating amount is multiplied and a second coefficient (e.g., β') that is added to the product of the first coefficient and the operating amount.

Aspect 21

The linear function may have a known third coefficient (e.g., γ) with which the sum of the product and the second coefficient is multiplied. It is difficult to directly measure the temperature of the fixing film 31. On the other hand, as described in relation to equation (2), there is a constant relationship between the temperature of the fixing film 31 and the temperature of the heater 33. Accordingly, the temperature measured by the thermistor 231 can be converted into a temperature of the fixing film 31, by using the known third coefficient.

Aspect 22

The modification unit 308 may derive the modified prediction equation, by calculating the first coefficient and the second coefficient based on information that is held in the recording unit. This information includes a first operating amount, a first correction amount associated with the first operating amount, and an analysis result associated with the first operating amount. Furthermore, this information may include a second operating amount, a second correction amount associated with the second operating amount, and an analysis result associated with the second operating amount.

Aspect 23

The image forming unit 25 may have a fixing unit (e.g., fixer 18) that fixes a toner image formed on a sheet P to the sheet by heating the toner image. The fixing unit has a pressure roller 32 and a film member (e.g., fixing film 31) that is provided opposing the pressure roller, and, together with the pressure roller, sandwiches and conveys the sheet P. Furthermore, the fixing unit has the heater 33 that heats the film member to a predetermined target temperature and a measurement unit (e.g., thermistor 231) that measures the temperature of the heater. The fixing control unit 302 controls the heater 33 such that the temperature measured by the measurement unit approaches the target temperature. In this case, the control parameter may be the target temperature of the heater 33.

Aspect 24

The film member is a member that wears as the operating amount increases. The fixing unit sometimes has a characteristic by which the surface temperature of the film member and the temperature of the heater diverge as the film member wears. In this case, the correction amount functions as a correction amount for correcting the divergence between the surface temperature of the film member and the temperature of the heater.

Aspect 25

As shown in FIG. 7B, the reading result of the test image may be a reading result of a region, on the sheet P, that is separated by a predetermined distance from the test image. In particular, the predetermined distance is equal to the peripheral length of a cylindrically-shaped film member (e.g., fixing film 31). As mentioned above, hot offset can occur for every distance that is an integer multiple of the peripheral length of the fixing film 31. Accordingly, the computation amount accompanying image analysis is reduced by focusing on distances that are an integer multiple of the peripheral length of the fixing film 31. Also, the influence of toner grime accompanying factors other than hot offset can be reduced.

Aspect 26

In the image forming unit 25, the photosensitive drum 1 functions as a photoreceptor. The developing roller 3 functions as a developing unit that uses toner to develop an electrostatic latent image formed on the photoreceptor and form a toner image. The primary transfer roller 6, the intermediate transfer belt 8 and the secondary transfer roller 11 function as a transfer unit that transfers the toner image from the photoreceptor to a sheet. The power source device 322 functions as an application unit that applies a transfer bias to the transfer unit. In this case, the control parameter may be the transfer bias. A phenomenon known as fogging occurs when the developing roller 3 wears. Fogging is a phenomenon where toner adheres to a non-image part around the toner image. By reading a test image, the CPU 300 is able to measure the density of fogging. In other words, the prediction equation of the correction amount of transfer bias may be modified, by employing the fogging density instead of the offset density Doff. The fogging density, the correction amount and the sheet count can be stored in the memory 301 in association with each other.

Aspect 27

In relation to the fogging density, the reading result of a sheet is the reading result of a non-image region, on the sheet, to which a toner image is not transferred. This is because fogging occurs in a non-image region.

Aspect 28

An image forming apparatus (e.g., image forming system) may have a printer (e.g., image forming apparatus 100) and an external device (e.g., information processing apparatus 1000) connected to the printer. In this case, a recording unit (e.g., memory 301*a*) may be provided in the external device. In this case, it is possible to reduce the storage capacity of the memory 301 of the image forming apparatus 100.

Aspect 29

The lifetime computation unit 325 functions as a lifetime computation unit that computes a parameter (e.g., R) indicating the remaining lifetime of a member involved with image formation in the image forming unit based on the sum obtained by adding the second coefficient to the product of the first coefficient and the operating amount. The display device of the operation unit 321 functions as a display unit that displays the parameter indicating the remaining lifetime. The user will thereby be able to readily comprehend the remaining lifetime and replacement period of the member.

Other Embodiments

Embodiment(s) of the present invention can also be realized by a computer of a system or apparatus that reads out and executes computer executable instructions (e.g., one or more programs) recorded on a storage medium (which may also be referred to more fully as 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-134012 filed Jul. 19, 2019, which is hereby incorporated by reference herein in its entirety.

What is claimed is:

1. An image forming apparatus comprising:

an image forming unit configured to form an image on a sheet;

a control unit configured to control the image forming unit;

a reading unit configured to read the sheet;

an analysis unit configured to analyze a reading result acquired by the image formed on the sheet being read by the reading unit, and output an analysis result;

a storage unit configured to store a printing condition used when the image was formed and the analysis result in association with each other; and a computation unit configured to compute a control parameter that is used by the control unit in order to control the image forming unit, with reference to a plurality of pairs of the analysis result and the printing condition stored in the storage unit.

2. The image forming apparatus according to claim 1, wherein the control parameter computed by the computation unit is a correction amount relating to control of the image forming unit that depends on a use amount of a member constituting the image forming unit.

3. The image forming apparatus according to claim 1, wherein the printing condition includes at least one of a use amount of a member constituting the image forming unit and a control parameter of the member.

4. The image forming apparatus according to claim 1, wherein the image forming unit is configured to form a test image, the reading unit is configured to read the test image, and the analysis unit is configured to analyze a reading result acquired by the test image being read by the reading unit, and output the analysis result.

5. An image forming apparatus comprising:

an image forming unit configured to form an image on a sheet;

a control unit configured to control the image forming unit;

a reading unit configured to read the sheet;

an analysis unit configured to analyze a reading result acquired by the image formed on the sheet being read by the reading unit, and output an analysis result;

a storage unit configured to store a printing condition used when the image was formed and the analysis result in association with each other; and a state determination unit configured to determine a state of a member constituting the image forming unit with reference to a plurality of pairs of the analysis result and the printing condition stored in the storage unit.

6. The image forming apparatus according to claim 5, wherein the state determined by the state determination unit is a remaining lifetime of the member constituting the image forming unit.

7. The image forming apparatus according to claim 5, wherein the printing condition includes at least one of a use amount of the member constituting the image forming unit and a control parameter of the member.

8. The image forming apparatus according to claim 5, wherein the image forming unit is configured to form a test image, the reading unit is configured to read the test image, and the analysis unit is configured to analyze a reading result acquired by the test image being read by the reading unit, and output the analysis result.

9. An image forming system comprising an image forming apparatus and an external device, the system comprising:

an image forming unit configured to form an image on a sheet;

a control unit configured to control the image forming unit;

a reading unit configured to read the sheet;

an analysis unit configured to analyze a reading result acquired by the image formed on the sheet being read by the reading unit, and output an analysis result;

a storage unit configured to store a printing condition used when the image was formed and the analysis result in association with each other; and a computation unit configured to compute a control parameter that is used by the control unit in order to control the image forming unit, with reference to a plurality of pairs of the analysis result and the printing condition stored in the storage unit, wherein the image forming unit, the control unit and the reading unit are provided in the image forming apparatus, the analysis unit is provided in one of the image forming apparatus and the external device, the storage unit is provided in one of the image forming apparatus and the external device, and the computation unit is provided in one of the image forming apparatus and the external device.

10. The image forming system according to claim 9, wherein the control parameter computed by the computation unit is a correction amount relating to control of the image forming unit that depends on a use amount of a member constituting the image forming unit.

11. An image forming system comprising an image forming apparatus and an external device, the system comprising:

an image forming unit configured to form an image on a sheet;

a control unit configured to control the image forming unit;

a reading unit configured to read the sheet;

an analysis unit configured to analyze a reading result acquired by the image formed on the sheet being read by the reading unit, and output an analysis result;

a storage unit configured to store a printing condition used when the image was formed and the analysis result in association with each other; and a state determination unit configured to determine a state of a member constituting the image forming unit with reference to a plurality of pairs of the analysis result and the printing condition stored in the storage unit, wherein the image forming unit, the control unit and the reading unit are provided in the image forming apparatus, the analysis unit is provided in one of the image forming apparatus and the external device, the storage unit is provided in one of the image forming apparatus and the external device, and the state determination unit is provided in one of the image forming apparatus and the external device.

12. The image forming system according to claim 11, wherein the state determined by the state determination unit is a remaining lifetime of the member constituting the image forming unit.

13. The image forming system according to claim 11, wherein the printing condition includes at least one of a use amount of the member constituting the image forming unit and a control parameter of the member.

14. The image forming system according to claim 11, wherein the image forming unit is configured to form a test image, the reading unit is configured to read the test image, and the analysis unit is configured to analyze a reading result acquired by the test image being read by the reading unit, and output the analysis result.

15. An image forming apparatus comprising:

an image forming unit configured to form an image on a sheet;

a measurement unit configured to measure an operating amount of the image forming unit;

a computation unit configured to compute a correction amount of a control parameter by substituting the operating amount into a prediction equation of the correction amount;

a correction unit configured to correct the control parameter based on the correction amount;

a control unit configured to control the image forming unit based on the control parameter;

a reading unit configured to read the sheet;

a determination unit configured to determine whether the prediction equation needs to be modified based on a plurality of reading results of the sheet by the reading unit; and a modification unit configured to, when the determination unit determines that the prediction equation needs to be modified, modify the prediction equation based on the plurality of the reading results of the sheet.

16. The image forming apparatus according to claim 15, wherein the control unit, when a predetermined determination execution condition is satisfied, controls the image forming unit to form a test image on the sheet, and causes the reading unit to read the test image formed on the sheet, and the determination unit determines whether the prediction equation needs to be modified based on a reading result of the test image.

17. The image forming apparatus according to claim 16, wherein the reading result of the test image is a reading result of a region, on the sheet, that is separated by a predetermined distance from the test image.

18. The image forming apparatus according to claim 16, wherein the predetermined determination execution condition is that an amount of increase in the operating amount of the image forming unit has reached a given amount.

19. The image forming apparatus according to claim 18, wherein the operating amount is a number of sheets fed to the image forming unit.

20. The image forming apparatus according to claim 16, further comprising:

a recording unit configured to, when the predetermined determination execution condition is satisfied, record an analysis result obtained from the reading result of the test image and a printing condition that includes the operating amount and the correction amount in association with each other, wherein the modification unit modifies the prediction equation based on a first operating amount held in the recording unit, a first correction amount associated with the first operating amount, an analysis result associated with the first operating amount, a second operating amount held in the recording unit, a second correction amount associated with the second operating amount, and an analysis result associated with the second operating amount.

21. The image forming apparatus according to claim 20, wherein the prediction equation is a linear function with the operating amount as a variable.

22. The image forming apparatus according to claim 21, wherein the linear function has a first coefficient with which the operating amount is multiplied, and a second coefficient that is added to a product of the first coefficient and the operating amount.

23. The image forming apparatus according to claim 22, wherein the linear function further has a known third coefficient with which a sum of the product and the second coefficient is multiplied.

24. The image forming apparatus according to claim 22, wherein the modification unit derives the modified prediction equation, by computing the first coefficient and the second coefficient based on a first operating amount held in the recording unit, a first correction amount associated with the first operating amount, an analysis result associated with the first operating amount, a second operating amount held in the recording unit, a second correction amount associated with the second operating amount, and an analysis result associated with the second operating amount.

25. The image forming apparatus according to claim 20, wherein the image forming apparatus has a printer and an external device connected to the printer, and the recording unit is provided in the external device.

26. The image forming apparatus according to claim 20, further comprising:

a lifetime computation unit configured to compute a parameter indicating a remaining lifetime of a member involved with image formation in the image forming unit based on a sum obtained by adding the second coefficient to a product of the first coefficient and the operating amount; and a display unit configured to display the parameter indicating the remaining lifetime.

27. The image forming apparatus according to claim 16, wherein the image forming unit has a fixing unit configured to fix a toner image formed on a sheet to the sheet by heating the toner image, the fixing unit has:

a pressure roller;

a film member provided opposing the pressure roller, and configured, together with the pressure roller, to sandwich and convey the sheet;

a heater configured to heat the film member to a predetermined target temperature; and a measurement unit configured to measure a temperature of the heater, the control unit performs control such that the temperature measured by the measurement unit approaches the target temperature, and the control parameter is the target temperature.

28. The image forming apparatus according to claim 27, wherein the film member is a member that wears as the operating amount increases, the fixing unit has a characteristic by which a surface temperature of the film member and the temperature of the heater diverge as the film member wears, and the correction amount is a correction amount for correcting the divergence between the surface temperature of the film member and the temperature of the heater.

29. The image forming apparatus according to claim 28, wherein the reading result of the test image is a reading result of a region, on the sheet, that is separated by a predetermined distance from the test image, the predetermined distance being equal to a peripheral length of the film member which is cylindrical in shape.

30. The image forming apparatus according to claim 15, wherein the image forming unit has:

a photoreceptor;

a developing unit configured to use toner to develop an electrostatic latent image formed on the photoreceptor and form a toner image;

a transfer unit configured to transfer the toner image from the photoreceptor to a sheet; and an application unit configured to apply a transfer bias to the transfer unit, and the control parameter is the transfer bias.

31. The image forming apparatus according to claim 30, wherein the reading result of the sheet is a reading result of a non-image region, on the sheet, to which the toner image is not transferred.

* * * * *